US005712511A

United States Patent [19]

Chan et al.

[11] Patent Number: 5,712,511

[45] Date of Patent: Jan. 27, 1998

[54] PREPARATION OF FINE PARTICULATE CL-20

[75] Inventors: May L. Chan; Alan D. Turner, both of Ridgecrest, Calif.

[73] Assignee: The United States of America as represented by the Secretary of the Navy, Washington, D.C.

[21] Appl. No.: 805,864

[22] Filed: Mar. 3, 1997

[51] Int. Cl.[6] ..... C06B 21/00

[52] U.S. Cl. ..... 264/3.4; 149/92; 241/1; 241/21

[58] Field of Search ..... 241/1, 21; 264/3.4; 149/92

[56] References Cited

U.S. PATENT DOCUMENTS

| | | | |
|---|---|---|---|
| 4,065,529 | 12/1977 | Lavertu et al. | 264/3.4 |
| 5,020,731 | 6/1991 | Somoza et al. | 241/1 |
| 5,197,677 | 3/1993 | Estabrook et al. | 241/21 |
| 5,467,714 | 11/1995 | Lund et al. | 102/284 |
| 5,587,553 | 12/1996 | Braithwaite et al. | 264/3.1 |

OTHER PUBLICATIONS

F. Baillou, Influence of Crystal Defects On Sensitivity of Explosives S.N.P.E. Centre de Recherches du Bouchet—BP2, 91710 Vert le Petit, France, pp. 816–823.

Donna Price et al., The NOL Large Scale Gap Test, III. Compilation of Unclassified Data and Supplementary Information for Interpretation of Results, Naval Ordnance Laboratory, White Oak, MD, Mar. 8, 1974.

*Primary Examiner*—Edward A. Miller

*Attorney, Agent, or Firm*—Melvin J. Sliwka; Stephen J. Church

[57] ABSTRACT

A high energy shock-insensitive explosive composition for use in deformable warheads. This high energy shock-insensitive explosive composition is comprised of a shock-insensitive explosive and hexa-nitro-hexa-aza-isowurtzitane constituting about 35–45 wt. % and a having an average particle size of about 3 μm. The high performance explosive consists of ammonium nitrate, nitroguanidine, 3-nitro-1,2,4-triazol-5-one, or mixtures of the three and constitutes about 30–40 wt. %.

The CL-20 explosive is wet ground in aqueous alcohol to reduce the size thereof, prior to incorporation in the explosive.

3 Claims, No Drawings

PREPARATION OF FINE PARTICULATE CL-20

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

MICROFICHE APPENDIX

Not Applicable.

BACKGROUND OF THE INVENTION

1. Field of the Invention

The present invention relates in general to a deformable type warhead. More particularly, the invention relates to a high explosive deformable composition that exhibits the necessary capabilities to produce desired warhead effects. This particular explosive composition can survive the shock environment generated by detonating forming charges preventing the explosive fill from detonating prior to reaching the target.

2. Description of the Prior Art

Deformable warhead technology is important to the development of directional ordnance such as those used against airborne targets. Most missile warheads used against airborne targets are directional to a degree; that is, they are axisymmetric rather than isotropic. Conventional missiles disperse the greatest part of their energy and kill mechanisms (fragments, rods, etc.) uniformly around the missile axis. The objective of deformable warhead technology is that when detonated, a high proportion of the warhead's energy and kill mechanism will be focused toward the target.

In order to understand the significance of this invention a discussion of a the physical characteristics of a typical Directional Ordnance System (DOS) follows. The outer shroud of the warhead contains the antenna elements for the target-detecting device (TDD), which is located at the back of the warhead section. Immediately inside the shroud is the deforming charge assembly. This consists of two concentric shells of carbon-graphite material segmented into a number of compartments, each of which is filled with a deforming charge explosive. The compartments are separated by steel bars that prevent sympathetic propagation between the compartments. Beneath the deforming-charge casing and separated by a layer of dense foam or cork, is the steel warhead case which provides the primary kill mechanism of the warhead. Inside the warhead case is the explosive fill. The warhead is capped at the aft end by a fiber-reinforced polypropylene plate. At the forward end of the warhead is the electronic safe-arm device (ESAD) and the warhead initiation system (WIS), containing the circuitry and explosive trains by which fire signals are transmitted to the deforming charges and the main charge. The ESAD is an in-line system that maintains the fuse in the safe condition.

What follows is how a typical DOS operates. The azimuthal-sensing TDD detects the target in one or more of the sensor regions extending forward in space around the axis of the missile. The TDD determines an aim direction and calculates the optimal delay time between the start of warhead deformation ($t_o$) and warhead detonation ($t_D$). If there is insufficient time to deform the warhead before firing the main charge, the TDD selects the non-deforming detonation mode. If sufficient time for deformation exists, the TDD selects the direction in which the warhead's fragments should be directed and communicates the direction and firing-time information to the ESAD.

The ESAD selects and detonates several adjacent deforming charges that center on the desired direction of the blast. This detonation deforms the warhead into a "D" shape, with the flat side of the "D" directed toward the target. As the deforming event is occurring, the ESAD is selecting the main-charge initiators on the side of the warhead opposite the deformation. After an appropriate time interval to allow for the correct degree of deformation, the ESAD fires the exploding-foil initiators which sets off the main charge on the side opposite the deformation allowing the warhead fragments to be projected in a concentrated beam toward the target.

The primary technical challenge associated with DOS explosives has been to select a main-charge explosive that is sufficiently energetic to provide adequate fragment velocity yet at the same time resistant to premature detonation from the case-deforming charge which exerts a pressure on the main charge of about 50 Kbars.

Most high energy explosive compositions that contain high levels of explosive solid such as cyclotetramethylenetetranitramine (HMX), cylotrimethylenetrinitramine (RDX) and hexa-nitro-hexa-aza-isowurtzitane (CL-20) are unable to survive the shock produced by the detonation of forming charges without detonating. For example, PBXN-110 (a plastic bonded explosive) containing 88% of HMX in a hydroxy-terminated polybutadiene (HTPB) binder, has failed to survive the shock generated by forming charges without detonating. As a result, the main explosive fill in the warhead detonates before the warhead case deforms properly, resulting in a loss in efficiency of the warhead's true capability directed towards a target. For these reasons, explosive compositions that exhibit high performance and are able to survive the shock generated by detonating forming charges are needed to produce the desired level of warhead performance.

An experimental composition, PBXW 128, was developed for test and evaluation in the sub scale aimable warhead configuration. PBXW-128 is an insensitive castable plastic bonded explosive (PBX). It contains 77% of class V octahydro-1,3,5,7-tetranitro-1,3,5,7-tetrazocine (HMX) in 23% hydroxyl-terminated polybutadiene (HTPB) binder. The binder consists of HTPB polymer and isodecyl pelargonate (IDP). Results to date have indicated that PBXW-128 can survive shock stimuli, but it has poor performance (calculated Pcj=210 kbar, Pcj is a measure of the steady state detonation pressure) which is about 15–20% lower in energy than the state of the art high energy PBX's (plastic bonded explosives).

BRIEF SUMMARY OF THE INVENTION

It is therefore an object of the present invention to provide a high energy shock-insensitive explosive composition that can be used as a main charge in directional ordnance capable of projecting a concentrated beam of fragments toward a target.

It is another object of the present invention to provide a high energy shock-insensitive explosive composition which can survive the shock produced by detonation of forming charges without itself being detonated.

It is yet another object of the present invention to provide a high energy shock-insensitive explosive composition which can undergo deformation upon the detonation of forming charges without itself detonating and, at the same time, produce high energies when it is detonated.

The applicants have unexpectedly discovered that the objects of the present invention can be attained with a high energy shock-insensitive explosive composition. This composition is made up of a mixture of particles of a shock-insensitive explosive and a high performance explosive of hexa-nitro-hexa-aza-isowurtzitane (CL-20), wherein the high performance explosive has the following chemical formula:

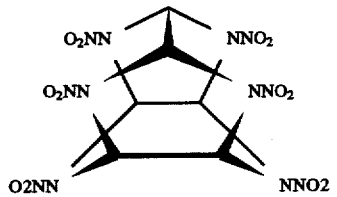

CL-20 (HEXAAZAHEXANITROISOWURTZITANE)

The shock-insensitive explosive used in the composition of the present invention can be ammonium nitrate (AN), nitroguanidine (HBNQ), 3-nitro-1,2,4-triazole-5-one (NTO), or mixtures thereof. According to the present invention, the particles of CL-20 have been finely ground to an average particle size of about 3 μm to remove crystalline defects and to shock-desensitize the composition.

According to a preferred embodiment of the present invention, the high energy shock-insensitive explosive composition of the present invention contains a shock-insensitive explosive constituting about 30–40 wt. % and the CL-20 constituting about 35–45 wt. %.

The high energy shock-insensitive explosive of the present invention can be formulated with a binder into a moldable material by mixing with a polymer binder such as hydroxy-terminated polyesters (i.e. polycaprolactone (PCP), polyethyleneglycol adipate or a copolymer of ethyleneglycol and tetrahydrofuran) in the range of about 4.5 to 5.2% by weight.

Advantageously, a plasticizer can be added to the high energy shock-insensitive explosive composition of the present invention. Preferred plasticizers include mixtures of any two or three of the plasticizers such as trimethylolethane trinitrate (TMETM), triethyleneglycoldinitrate (TEGDN), acetyltriethyl citrate (ACET), tributyrin (glyceryl tributyrate), n-butyl-2-nitratoethyl-nitramine (butyl NENA) or triacetin (glyceryl triacetate). The above plasticizer contents are used in the range of about 12–20% by weight.

The level of the solid content for CL-20, ammonium nitrate (AN), 3-nitro-1,2,4-triazol-5-one (NTO) or high bulk density nitroguanidine (HBNQ) can be adjusted to plus or minus 2–4 wt. % in order to optimize the processing and performance aspects of the composition.

Preferably, the high energy shock-insensitive explosive composition of the present invention also contains a cross-linking agent to enhance the cure of the explosive composition. Any of the conventional cross-linking agents, such as nitrocellulose, can be used in an amount of about 0.5–0.8 wt. %. Desirably, a chemical stabilizer can be used for the explosive composition. A preferred stabilizer includes N-methyl p-nitroaniline (MNA) or diphenyl amine (2n-DPA), which is preferably present in the composition in an amount of from about 0.5–0.7 wt. %.

In a preferred embodiment of the present invention, a curing catalyst is used in the high energy shock-insensitive explosive composition of the present invention to promote curing of the cast explosive. Preferred curing catalysts include triphenyl bismuth (TPB) and dinitrosalicylic acid (DNSA) in an amount of about 0.025–0.03 wt. %.

In addition, a curative agent is incorporated in the explosive composition of the present invention to effectively cure the polymer. Preferred curing agents are isocyanate curatives such as hexamethylene diisocyanate or isophenone diisocyanate which are present in the composition in an amount of about 0.5–1.0 wt. %. According to the present invention, the high energy shock-insensitive explosive composition is used as the main charge in a deformable warhead.

When high explosive crystals are devoid of crystalline defects, they become much more resistant to shock initiation. Crystalline defects in high explosives have been blamed as the source of hot spot initiation. The reduction in defects can be accomplished by grinding the crystals to smaller sizes or improving the crystal quality by better recrystallization methods.

In order for the explosive composition to operate most effectively, a high energy, shock insensitive explosive must comprise about 75–80% of the total solid content. If all fine particles of CL-20 were utilized in the explosive, only about 40–42% of the total solid could be utilized before the mix would become to viscous to process. For the high energy, shock-insensitive explosive composition of the present invention, it is preferred to use a mixture of coarse and fine particles of solid explosive materials. The larger particle size insensitive explosives used in the composition are AN, NTO, and HBNQ. The fine particles consist of finely ground CL-20. The Cl-20 provides the high energy and shock resistance, since fine particle have much less crystalline defects or cracks as compared with large particles.

DETAILED DESCRIPTION OF THE INVENTION

This invention comprises a new explosive formulation containing an energetic binder, CL-20, and shock insensitive explosive solids such as AN, HBNQ, NTO or mixtures thereof. This formulation can provide much higher energy levels and lower shock sensitivity then previous materials. The energy levels of these new explosives have calculated energies equal to or higher than previously known materials (calculated Pcj=290 kbar). It is well documented that when high explosive crystals lack crystalline defects, the crystals become much more resistant to shock initiation (Influence of Crystal Defects On Sensitivity of Explosives, F. Baillou, J. M. Dartyge, C. Spyckerelle and J. Mala, published in the Proceedings of the Tenth International Detonation Symposium, Boston, Mass., Jul. 12–16, 1993, pages 816–823). Crystalline defects occurring in high explosives in the past have been blamed as the source of hot spot initiation. The defects can be reduced by grinding the crystals to smaller sizes or improving the crystalline quality by better recrystillization methods. For the high energy, shock insensitive explosives of this invention, a mixture of coarse and fine particles of solid explosive materials was prepared. The larger particle size insensitive explosives utilized are AN, NTO, HBNQ or mixtures thereof. The finely ground particles are CL-20. CL-20 is reduced to an average particle size of about 5 μm using a SWECO mill. Cylindrical ceramic beads are placed in the SWECO mill along with an ethanol/distilled water mixture and the CL-20. The CL-20 is then ground in the mill using this unique mixture until an optimum particle size is achieved. The CL-20 powder is then filtered and dried before using (see example 1). The CL-20 has much fewer crystalline defects or cracks compared to the larger particles when the above process is followed.

Preferred explosive compositions prepared according to the present invention are shown in Table 1.

TABLE 1

High Energy Deformable Explosives for Warheads (wt % of each ingredient)

| Composition | 1 | 2 | 3 | 4 |
|---|---|---|---|---|
| PCP | 4.8–5.2 | 4.8–5.2 | 4.8–5.2 | 4.8–5.2 |
| TMETN | 7–12 | 7–12 | 7–12 | — |
| TEGDN | 5–12 | 5–12 | 5–12 | 9–12 |
| ACET | — | — | — | 5–7 |
| NC | 0.3–0.7 | 0.3–0.7 | 0.3–0.7 | 0.3–0.5 |
| MNA | 0.2–0.5 | 0.2–0.5 | 0.2–0.5 | 0.2–0.3 |
| HMDI | 0.45 | 0.45 | 0.45 | 0.45 |
| CL-20, 3 μm | 40.0 | 35.0 | 40.0 | 44.0 |
| AN, 40–200 μm | 35.0 | 40.0 | — | 36.0 |
| HBNQ, 150–200 μm | — | — | 20–28 | — |
| HBNQ, 50–75 μm | — | — | 5–10 | — |
| TPB | 0.025 | 0.025 | 0.025 | 0.025 |
| DNSA | 0.025 | 0.025 | 0.025 | 0.025 |
| END OF MIX | 18 @ | 12 @ | 22 @ | 10 @ |
| VISCOSITY, (Kp) | 116° F. | 118° F. | 117° F. | 120° F. |
| MEASURED DENSITY, g/cc | 1.68 | 1.65 | 1.71 | 1.68 |

"—" indicates Not Tested.

Preparation of the Explosive Composition:

Preferred plastic bonded explosives can be prepared as follows:

1) A binder preparation of polycaprolactone (PCP), trimethylolethane trinitrate (TMETN), triethyleneglycoldinitrate (TEGDN) and nitrocellulose (NC) are dissolved in a small amount of acetone to form a lacquer.

2) The lacquer is placed in a vertical shear mixer and about 4–5 separate additions of coarse and fine solid material are added with a 15-minute mixing period after each addition of solid. After proper mixing, the viscosity of these mixes is desirably less than 15 kilopoises.

3) The mixes are then vacuum cast into various test vessels and cured for about 4 days in an oven at a temperature of 120° F.

EXAMPLE 1—CL-20 Grinding

Approximately 1500 pounds of ½"×½" cylindrical ceramic beads were placed into a 20-gallon SWECO mill. About 20 gallons of ethanol and 20 gallons of distilled water were poured into the mill. This raised the mixture level about 1.5 to 2 inches above the level of loaded beads. About 40 lbs. of CL-20 was then added and distributed as evenly as possible inside the mill. The mill was then set to run at about 1500 rpm throughout the grinding process. The temperature of the slurry ranged from 77° to 84° F. during the grinding process. The particle size of CL-20 was quickly reduced from 250 μm to less than 50 um in 2–3 hours and further reduced to 5 um in 12–16 hours, as summarized in Table II.

TABLE II

SWECO Grinding of CL-20

| Grinding Time, hr. | Avg. Particle size* | % over 15 μm |
|---|---|---|
| 1 | 251.0 | 95.8 |
| 2 | 181.0 | 89.0 |
| 3 | 7.3 | 27.5 |
| 4 | 6.7 | 4.7 |
| 5 | 6.1 | 3.1 |
| 6 | 6.2 | 1.7 |
| 8 | 5.5 | 0.5 |
| 10 | 4.8 | 0.1 |

TABLE II-continued

SWECO Grinding of CL-20

| Grinding Time, hr. | Avg. Particle size* | % over 15 μm |
|---|---|---|
| 11 | 5.5 | 1.7 |
| 12 | 6.3 | 2.5 |
| 14 | 5.5 | 1.3 |
| 17 | 7.6 | 3.6 |

* Particle size was assessed by using the Malvern particle size analyzer (Model 3600).

A slight degree of agglomeration was observed after 10–11 hours. After prolonged grinding periods, particles tend to appear to increase in size. The grinding experiment is purposely run for longer than necessary to determine the optimum time when minimum particle size can be achieved.

The particle size analyses of the SWECO-ground CL-20 revealed an average 5 μm particle size in a narrow distribution (less than 0.1% was greater than 15 μm size The optical microscopic examination revealed that these particles did not contain many of the crystalline defects typically present in larger crystals (i.e. 50–200 μm). The crystalline defects included gas or solvent inclusions, cracks or density gradients.

After the small particle size is achieved, the ground CL-20 powder is filtered and dried in an oven at 120° F. for approximately 10 days. After drying, the CL-20 is placed in double lined Velostat bags and placed in fiber drums for use.

A comparison was made between SWECO and conventional Fluid Energy Mill (FEM) ground CL-20. The results indicated that the SWECO-ground CL-20 contained mostly small particles, 3 to 5μm, with no particle larger than 50μm. On the other hand, nearly 20% of the particles from the FEM-ground CL-20 were larger than 15 um, as indicated in Table III.

TABLE III

Particle Size Analyses of CL-20

| CL-20 Type | Mean Particle Size, μm | % over 15 μm |
|---|---|---|
| (SWECO Ground) | 5.0 (wet) | 1.0 |
| (FEM Ground) | 7.6 μm | 19.7 |

Both SWECO and FEM are satisfactory mechanical grinding processes for reducing the particle size of energetic solids as long as the grinding process selected can eliminate particles with crystalline defects.

EXAMPLE 2—Shock Sensitivity and Safety Test Evaluation

The standard Naval Ordnance Lab (NOL) card gap test is a meaningful shock sensitivity test to measure the survivability of the explosive material in this application. (Reference: The NOL Large Scale Gap Test, Compilation of Unclassified Data and Supplementary Information for Interpretation of Results, by D. Price, A. R. Clairmont and J. O. Erkman, NOLTR 74-40, March 1974.) If the explosive composition does not detonate at 120 cards or less, the material will most likely survive the shock environment resulting from the forming charges.

All of the described compositions in Table 1, compositions 1, 2, 3 and 4, survived the NOL card gap test, when tested at 120 cards or lower. Two of the formulations, compositions 1 and 2, survived even higher shock inputs, as evidenced by no detonation at 80 and 70 cards, respectively.

The shock sensitivities of compositions 1, 2, 3 and 4 are outlined below:

TABLE IV

The Shock Sensitivity of Various DOS Explosives

| | | 1 | 2 | 3 | 4 |
|---|---|---|---|---|---|
| NOL card gap | 70 cards (70 kbar) | Go* | No go, No go | — | — |
| | 80 cards (65 kbar) | No go, No go | — | — | Go |
| | 100 cards (58 Kbar) | No go | — | Go | No go |
| | 120 cards (50 Kbar) | — | — | No go | No go |

*Cracked the witness plate, no hole. It was determined as a marginal go.
"—" indicates Not tested.

The safety test results are listed in Table V below. The explosive compositions (described in Table I) were found to be insensitive compared to HMX and much less impact sensitivity was observed. The compositions were also found to be relatively insensitive to friction and electrostatic hazards.

TABLE V

Safety Test Results

| | Impact, 50%, 2.5 Kg | ABL Friction | Electrostatic |
|---|---|---|---|
| Compositions 1, 2, 3 and 4 | 22 CM | 17/20 NF* @ 1000 lbs | 10/10 NF* @ 0.25 J |
| HMX (class 1) | 14 CM | 10/10 NF* @ 1000 lbs | 10/10 NF* @ 0.25 J |

NF* = No Fire

EXAMPLE 3—Calculated Performances

As illustrated in Table VI., when composition No. 3 was compared with PBXW 128, there was a 12.5% increase in fragment velocity which translates to a 27% increase in kinetic energy of a fragment. In addition to the higher fragment velocity, composition No. 3 has a higher density than that of PBXW-128; 1.70 vs. 1.52 g/cc. As a result, it would be possible to load 12% more explosive for a constant volume. This translates to a total of over 42% increase in energy level for the same volumetric loading of a warhead.

TABLE VI

Calculated Performance Comparison of PBX's

| | Measured density | Gurney Constant √2E | Initial Frag Velocity ft/sec |
|---|---|---|---|
| Composition No. 3 | 1.70 | 2.85 | 5777 |
| PBXW-128 | 1.52 | 2.65 | 5131 |

What is claimed is:

1. A process for reducing the particle size of hexa-nitro-hexa-aza-isowurtizane to an average particle size of about 5 μm, comprising the steps of:

placing cylindrical ceramic beads into a SWECO mill;

adding a mixture of ethanol/distilled water to said mill having a range of 40/60% ethanol to 60/40% distilled water;

adding said hexa-nitro-hexa-aza-isowurtizane to said mill;

distributing, as evenly as possible, said hexa-nitro-hexa-aza-isowurtizane throughout said mill; and allowing said grinding process to operate until a particle size of about 5 μm is achieved.

2. The reduction in particle size of said hexa-nitro-hexa-aza-isowurtizane as in claim 1, wherein said grinding process operates between about 1300 to 1700 rpm.

3. The reduction in particle size of said hexa-nitro-hexa-aza-isowurtizane as in claim 2, wherein said grinding process takes place for about 12 to 16 hours.

* * * * *